US006508626B1

(12) United States Patent
Sakurai et al.

(10) Patent No.: US 6,508,626 B1
(45) Date of Patent: Jan. 21, 2003

(54) TURBOMACHINERY IMPELLER

(75) Inventors: Takaki Sakurai, Tokyo (JP); Hideomi Harada, Kanagawa (JP); Kosuke Ashihara, Kanagawa (JP); Mehrdad Zangeneh, London (GB); Akira Goto, Kanagawa (JP)

(73) Assignees: Ebara Corporation, Tokyo (JP); University College of London, London (GB)

( * ) Notice: Subject to any disclaimer, the term of this patent is extended or adjusted under 35 U.S.C. 154(b) by 0 days.

(21) Appl. No.: 09/700,842

(22) PCT Filed: May 24, 1999

(86) PCT No.: PCT/GB99/01635

§ 371 (c)(1),
(2), (4) Date: Jan. 4, 2001

(87) PCT Pub. No.: WO99/61800

PCT Pub. Date: Dec. 2, 1999

(30) Foreign Application Priority Data

May 27, 1998 (GB) ..... 9811404

(51) Int. Cl.[7] ..... F01D 5/22
(52) U.S. Cl. ..... 416/180; 416/183
(58) Field of Search ..... 416/183, 188, 416/185, 179, 180, 203

(56) References Cited

U.S. PATENT DOCUMENTS

| | | | | | |
|---|---|---|---|---|---|
| 1,959,703 | A | * | 5/1934 | Birmann | 416/183 |
| 2,753,808 | A | * | 7/1956 | Kluge | 416/183 |
| 3,069,072 | A | * | 12/1962 | Birmann | 415/163 |
| 4,093,401 | A | * | 6/1978 | Gravelle | 416/188 |
| 5,002,461 | A | | 3/1991 | Young et al. | 416/183 |
| 5,639,217 | A | | 6/1997 | Ohtsuki et al. | 416/183 |

FOREIGN PATENT DOCUMENTS

| | | |
|---|---|---|
| DE | 345616 | 12/1921 |
| DE | 1 503 520 | 2/1997 |
| EP | 0 205 001 | 12/1986 |
| FR | 2 386 708 | 11/1978 |
| FR | 2 550 585 | 2/1985 |
| GB | 941343 | 11/1963 |
| JP | 5-604495 | 4/1981 |

OTHER PUBLICATIONS

M. Zangeneh, "On 3D Inverse Design of Centrifugal Compressor Impellers with Splitter Blades", ASME Turbo Expo 1998 Conference in Stockholm.

* cited by examiner

*Primary Examiner*—Edward K. Look
*Assistant Examiner*—Dwayne White
(74) *Attorney, Agent, or Firm*—Wenderoth, Lind & Ponack, L.L.P.

(57) ABSTRACT

Disclosed is an impeller for a turbomachine. The impeller comprises a hub, full blades equidistantly disposed on the hub in a circumferential direction, and a splitter blade disposed between each adjacent two of the full blades. The splitter blade is shaped in such a way that a spanwise distribution of a pitchwise position of a leading edge of the splitter blade is determined according to a spanwise and pitchwise non-uniformity distribution of fluid velocity of a fluid flowing into the splitter blade, whereby a non-dimensional circumferential position of a leading edge of the splitter blade varies in a spanwise direction.

10 Claims, 20 Drawing Sheets

$$0.5 < P_{shr,\,TE} < P_{shr}$$

$$0.5 < P_{hub,\,TE} < P_{hub}$$

Present invention

Present invention

Present invention

P < 0.42

P > 0.77

FIG. 17A
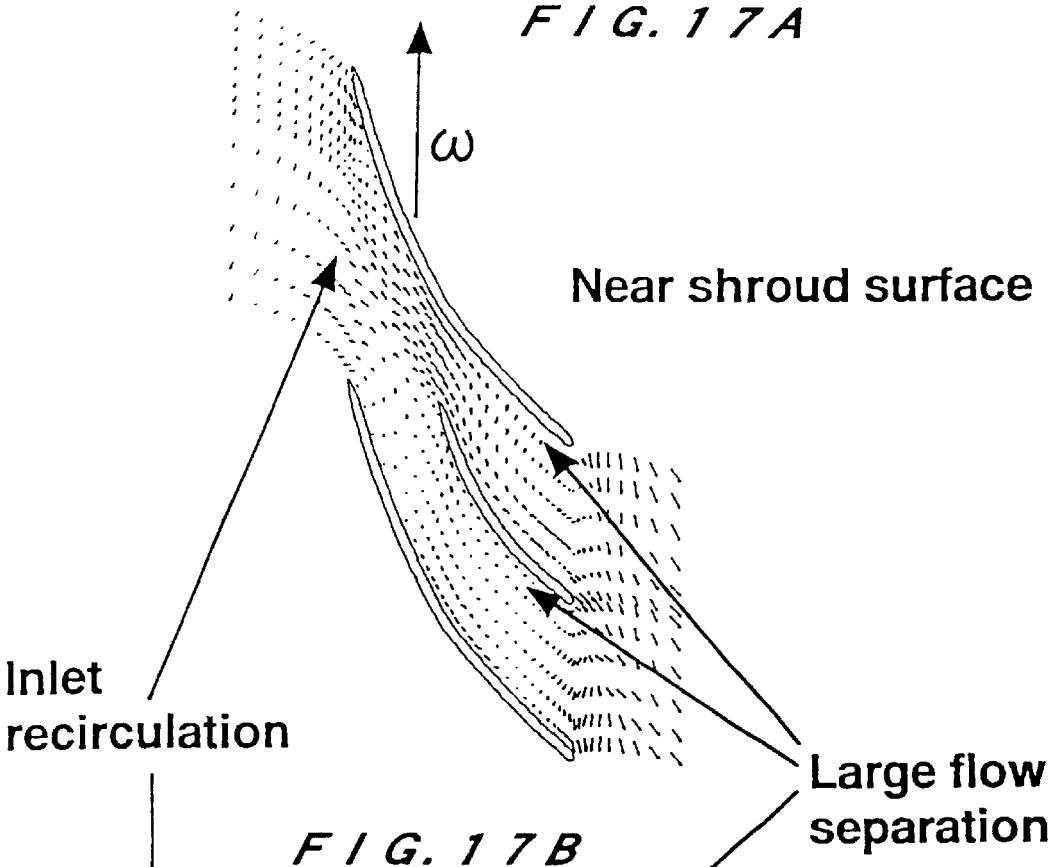
FIG. 17B
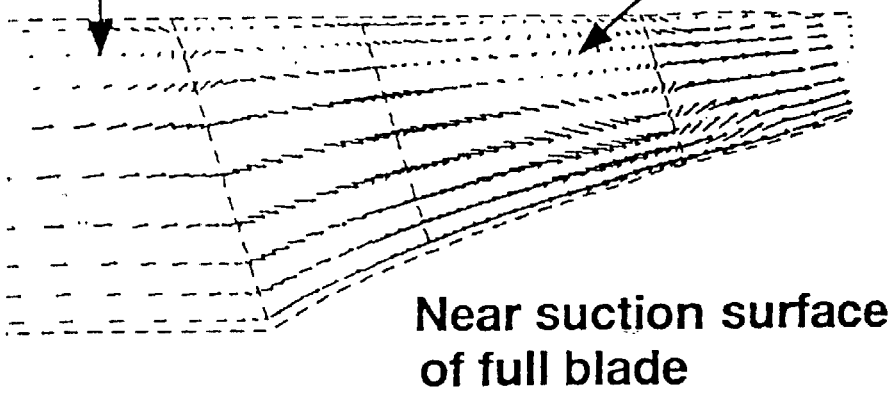
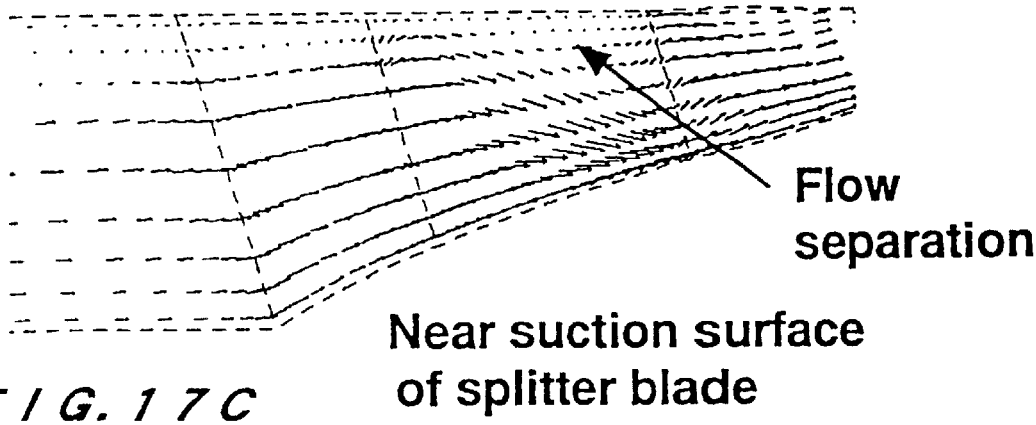
FIG. 17C

FIG. 18A
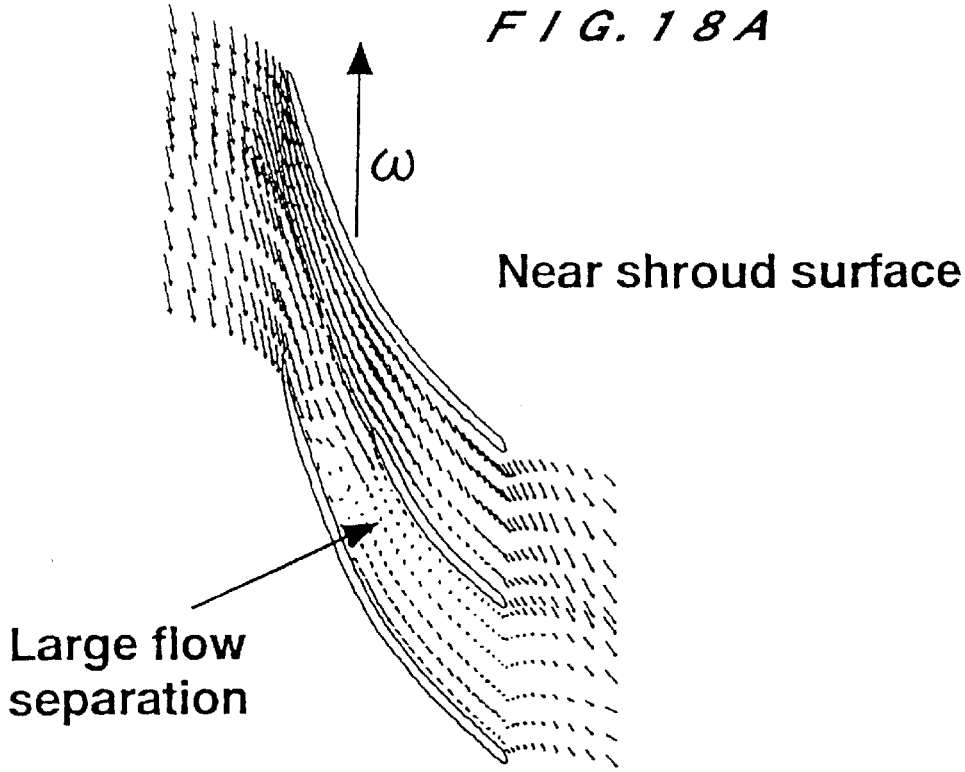
FIG. 18B
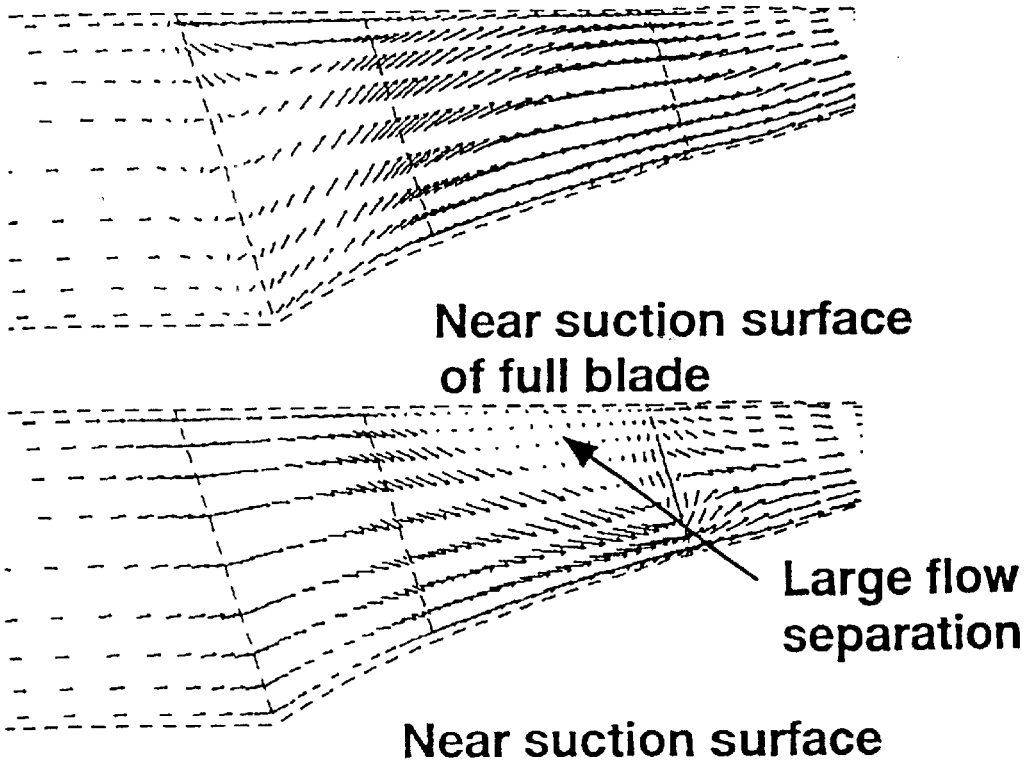
FIG. 18C

FIG. 19A
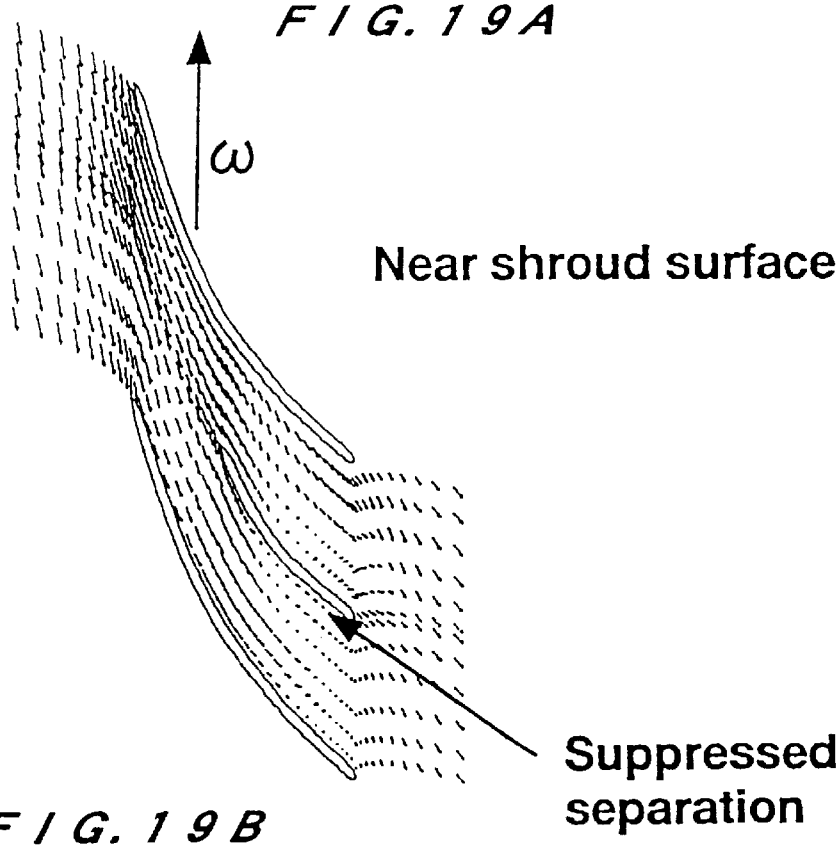
FIG. 19B
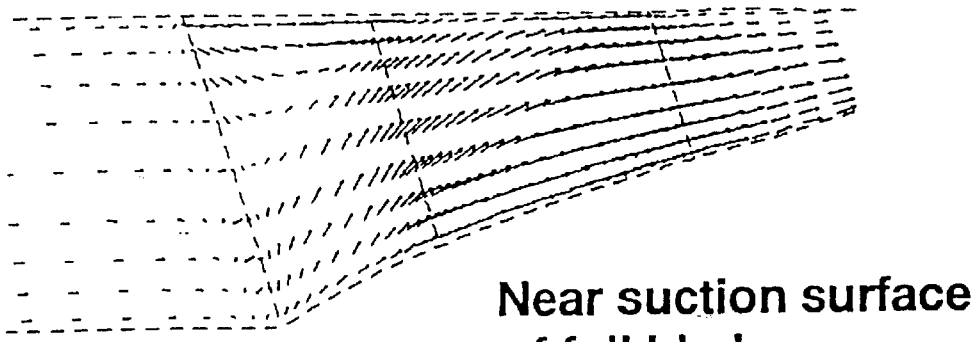
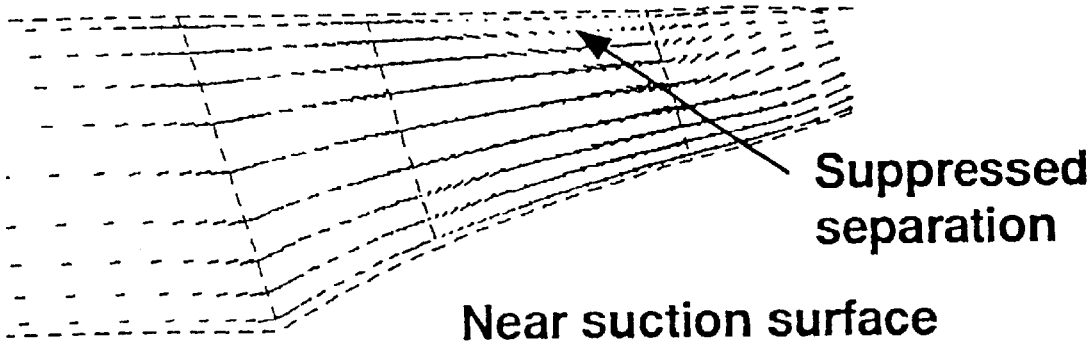
FIG. 19C

TURBOMACHINERY IMPELLER

BACKGROUND OF THE INVENTION

1. Field of the Invention

The present invention relates to turbomachineries such as pumps for transporting liquids or compressors for compressing gases, and relates in particular to turbomachineries comprising an impeller having short splitter blades between full blades for improving performance.

2. Description of the Related Art

FIGS. 1(*a*)–1(*c*) show a normal impeller comprised only by full blades. This type of impeller has a plurality of blades 3 on a curved outer surface of a truncated cone shaped hub 2 disposed equidistantly along a circumferential direction around a shaft 1. Flow passages are formed by a space formed by a shroud (not shown), two adjacent blades and the curved hub surface. The fluid enters the impeller space through an inlet opening near the shaft and flows out through the exit opening at the outer periphery of the impeller. The fluid is compressed and given a kinetic energy by the rotational motion of the impeller about the shaft so as to enable pressurized transport of the fluid by the turbomachinery.

Although some impellers are unshrouded, the clearance between the casing and the blade tip is set minimal so as to prevent a leakage flow therefrom. Therefore, the flow within the unshrouded impeller is substantially the same as that of an impeller having a shroud. Thus, in the explanations given for impellers having a shroud in this specification hereinafter, a term "shroud-side" should be construed as "casing side" or "blade tip side" for the unshrouded impellers.

One of the significant problems to be solved for such conventional turbomachineries is not only to improve their performance at a design flow rate, but to realize a wide operating range. For example, when pumps are operated at a flow rate beyond the design flow rate, local increase in the fluid velocity induces a local pressure drop at an inlet region of the impeller. And when the suction pressure is low, in particular, the fluid pressure will become less than the vapor pressure of the fluid in some regions. The result is a generation of so-called "cavitation" in which the fluid is vaporized, and it is well known that a pressurization effect of the pump is deteriorated due to blockage effect of bubbles.

On the other hand, if a compressor for compressing gas is operated at a flow rate beyond the design flow rate, the velocity becomes higher than the acoustic velocity in a region of the minimum cross section of the flow passage to cause a phenomenon of so-called "choking", and it is well known that, due to blocking of the gas passage, a compressing effect of the compressor is rapidly lost.

Such problems of degradation in the device performance, due to cavitation and choking phenomena, are caused by the fact that the pressurizing action of the impeller is interrupted due to reduction of the effective flow passage area, which is brought about by the enlargement of the vaporization regions for liquids or supersonic velocity regions for gases. An effective solution for improving suction capability of the turbomachinery is, therefore, to enlarge the flow passage area at an inlet region of the impeller. One approach is to remove a fore part of every other blade. In this case, those blades having the original blade length are called "full blades" and those with shorter blade length are called "splitter blades". Such impellers having splitter blades aim to increase the suction capability by increasing the flow passage area at an inlet region of the impeller by reducing the effective number of blades, and at the same time, the pressurizing effect of the blades is maintained in the latter part of the flow passage by splitter blades placed between the full blades.

FIGS. 2A–2C illustrate a conventional impeller with splitter blades. The impeller comprises full blades 4 and splitter blades 5 alternatingly on the hub 2 so that it can secure a wide flow passage at the inlet, and in the latter half, sufficient number of blades are provided to secure adequate pressurization effects. As described above, in view of convenience for manufacturing, such splitter-bladed impellers are made by machining off the fore part of every other full blade disposed equidistantly around the hub. The shape of the splitter blade is identical to that of the full blade except for the removed region, and the splitter blades are placed at the mid-pitch locations between the full blades.

However, in such an impeller having splitter blades made by removing a fore part of every other evenly spaced full blade, the fluid velocity at the suction surface 4*s* of a full blade 4 facing the inlet opening is increased while the fluid velocity at the pressure surface 4*p* of the opposite full blade 4 is decreased. Under these conditions, in the fore part of the flow passage where the leading half of the full blade is removed, the fluid cannot flow right in the direction along the blade surfaces. The result is a generation of flow fields mismatch due to the difference in the fluid flow angles and the blade angles at the inlet of the splitter blade, which induces a problem of flow separation at the splitter blade.

FIG. 3A shows a meridional geometry of the impeller with splitter blades shown in FIGS. 2A–2C having a specific speed of 400 (m3/min,m,rpm), and FIG. 3B is a contour diagram of meridional velocities of the flow on a ring-shaped flow passage formed at a section A—A in FIG. 3A, computed by a three-dimensional viscous flow calculation. FIGS. 4A–4B show similar diagrams for the impeller having a specific speed of 800 (m3/min,m,rpm). As can be understood from these drawings, the fluid velocities on the suction-side of the full blade are significantly higher over the area from the hub to the shroud than those on the pressure side, so that the mass of fluid passing through the impeller becomes more concentrated on the suction-side of the full blade.

When the splitter blade is positioned at a mid-pitch location between the full blades under such flow conditions, a phenomenon of flow imbalance is generated such that the mass of fluid flowing in the flow passage formed between the suction surface 4*s* and the pressure surface 5*p* is different from that between the pressure surface 4*p* and the suction surface 5*s*. This produces a disparity in such fluid dynamic parameters as outflow velocity and outflow angle at both sides of every splitter blade. It is known that such disparities cause a number of undesirable effects such as an increased loss due to flow mixing downstream of the impeller, and lowering of performance in the downstream diffuser section due to increased unsteadiness of the outflow from the impeller.

To relieve such mismatching in flow fields and non-uniformity in the flow passage for improving the performance of the impeller, it is generally considered that the splitter blade leading edge should be moved from the mid-pitch location towards the suction-side of the adjacent full blade. FR-A-2550585 is an example of teaching in this regard. For example, some of the remedial approaches to flow rate mismatching include: to reduce mismatching at the fluid inlet by making the flow passage width sizes the same on both sides at the splitter blade leading edge; to reduce the detrimental effect of flow rate non-uniformity by making the splitter blade trailing edge to be located at the same distance ratio between the full blades as its leading edge; and to displace the circumferential location of the splitter blades for optimizing the flow rate.

However, such known remedial techniques are not satisfactory enough to adequately optimize the position of the splitter blades. Specifically, as seen in FIGS. 3A, 3B, 4A and 4B, pitchwise or circumferential expansion of the high velocity region varies non-uniformity of the flow rate changes radically between the hub-side and shroud-side of the flow passage. Also, the fluid velocity is especially high on the shroud-side of the suction surface of the full blade, where flow rate inhomogeneity in the spanwise direction is also generated. Therefore, because the conventional techniques do not consider the effects of the three-dimensional nature of the fluid velocity distribution, adverse effects of the flow rate inhomogeneity on device performance have not been fully eliminated.

SUMMARY OF THE INVENTION

It is an object of the present invention to solve the problems of depressed performance caused by improper shape of the splitter blade and provide a clear design of proper splitter blades so as to provide an impeller with splitter blades having a wide operating range without affecting the performance of the turbomachinery.

The object has been achieved in an impeller for a turbomachinery comprising: a hub; a plurality of full blades equidistantly disposed on the hub in a circumferential direction; and a plurality of splitter blades disposed between each adjacent two of the full blades, wherein each of the splitter blades is shaped in such a way that a spanwise distribution of a pitchwise position of a leading edge of the splitter blade is determined according to a spanwise and pitchwise non-uniformity distribution of fluid velocity of a fluid flowing into the splitter blade, as illustrate by a schematic drawing shown in FIG. 5. Here, the term "spanwise" is used for a "thickness" direction of the impeller, that is, a direction along a straight line tying two corresponding points on the hub and the shroud (blade tip) in a meridional cross section as shown in FIGS. 3A or 4A. Also, the term "pitchwise" is used for a circumferential direction within a pitch between two adjacent full blades as shown in FIGS. 5A and 5B.

By adjusting the position of the splitter blade leading edge in the hub-to-shroud space, the impeller of the present invention with splitter blades enables mismatching of flow fields or non-uniform flow rates in the flow passages to be prevented, as well as the onset of impeller stall in partial flow regions to be prevented or destroyed. Therefore, it is possible to moderate the adverse effects of three-dimensional non-uniformity in the flowfields in the hub-to-shroud space in the impeller, so as to provide a high efficiency operation of the turbomachinery.

Each of a flow passage formed between the full blade and the splitter blade may be shaped in such a way that a flow separation on the aft part of the suction surfaces of the full blade and the splitter blade is avoided.

Also, each of the splitter blades may be shaped in such a way that a position of a leading edge of the splitter blade at a blade tip is displaced away from a mid-pitch position of adjacent full blades, and the leading edge of each of the splitter blades has a predetermined distribution of pitchwise position varying along a spanwise direction.

The distribution of the circumferential position may be determined according to a non-uniformity distribution of fluid flowing into the splitter blade.

It is desirable to locate any position of the leading edge within a range of non-dimensional parameter P as expressed in an inequality relation: $0.42<P<0.77$, where P is a pitchwise distance between the position and a circumferentially corresponding position on a blade camber line of a full blade adjacent to a suction side of the splitter blade which is normalized by a pitch distance between adjacent full blades (refer to FIG. 6).

And, as illustrated in a schematic drawing shown in FIG. 7, a trailing edge of the splitter blade may be displaced from a mid-pitch position of adjacent full blades in a circumferential direction as long as the pitchwise location is not beyond that of the leading edge of the splitter blade.

BRIEF DESCRIPTION OF THE DRAWINGS

FIGS. 17A~17C are various flow fields produced in the impeller shown in FIGS. 13A~13C with a fixed position of the splitter blades;

FIGS. 18A~18C are various flow fields produced in the impeller shown in FIGS. 13A~13C with other positions of the splitter blades;

FIGS. 19A~19C are various flow fields produced in the impeller shown in FIGS. 13A~13C with other positions of the splitter blades.

DESCRIPTION OF THE PREFERRED EMBODIMENTS

Preferred embodiments of the turbomachinery will be represented by impellers associated with compressors and pumps. Throughout the presentation, the specific speed is defined as: $Ns=NQ^{0.5}/H^{0.75}$ where N is the rotational speed of the impeller in rpm, Q is the flow rate in $m^3$/min and H is the head in meters.

Figure 5A:
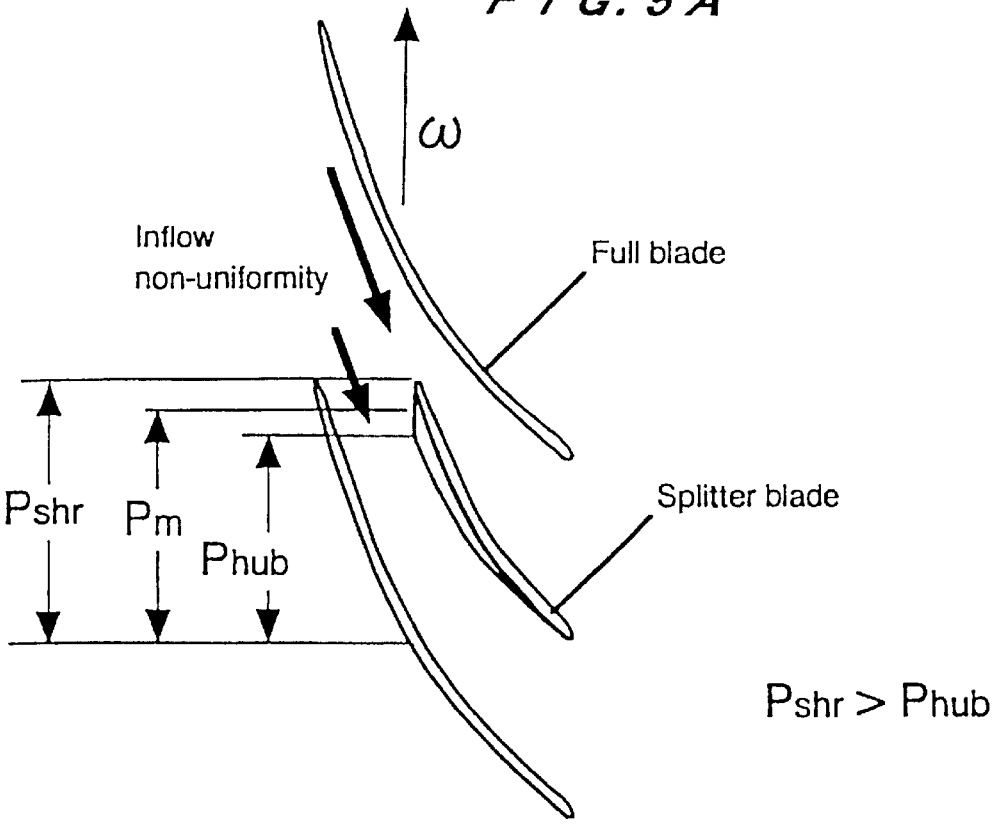
FIGS. 5A and 5B are schematic drawings of the impeller with splitter blades of the present invention.
Figure 5B:
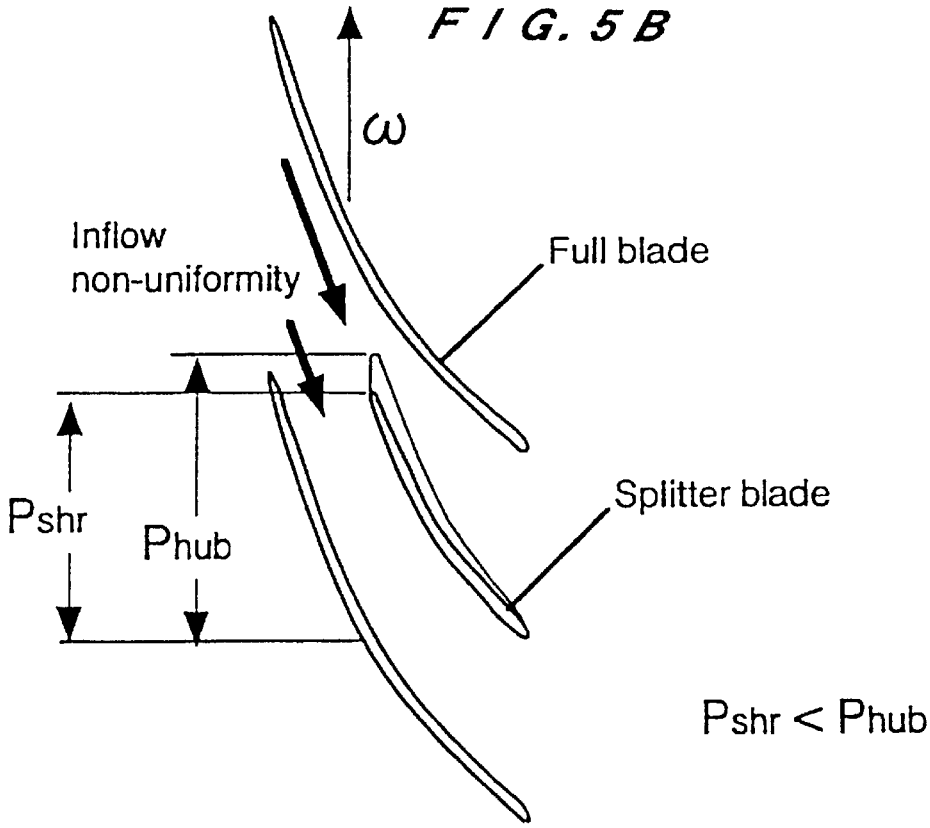
Figure 6:
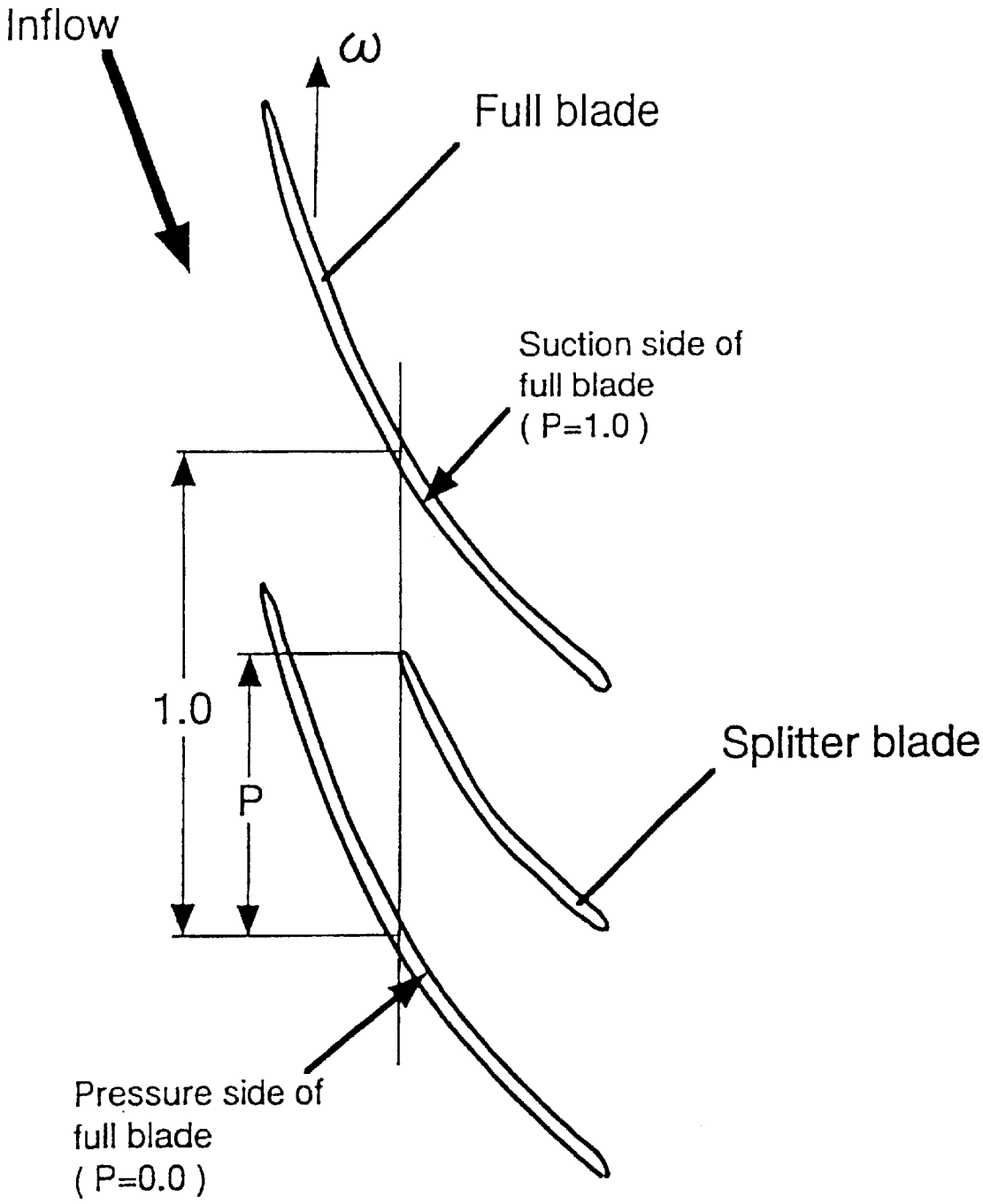
FIG. 6 is a drawing to explain the coordinate system used in the present invention.
Figure 7:
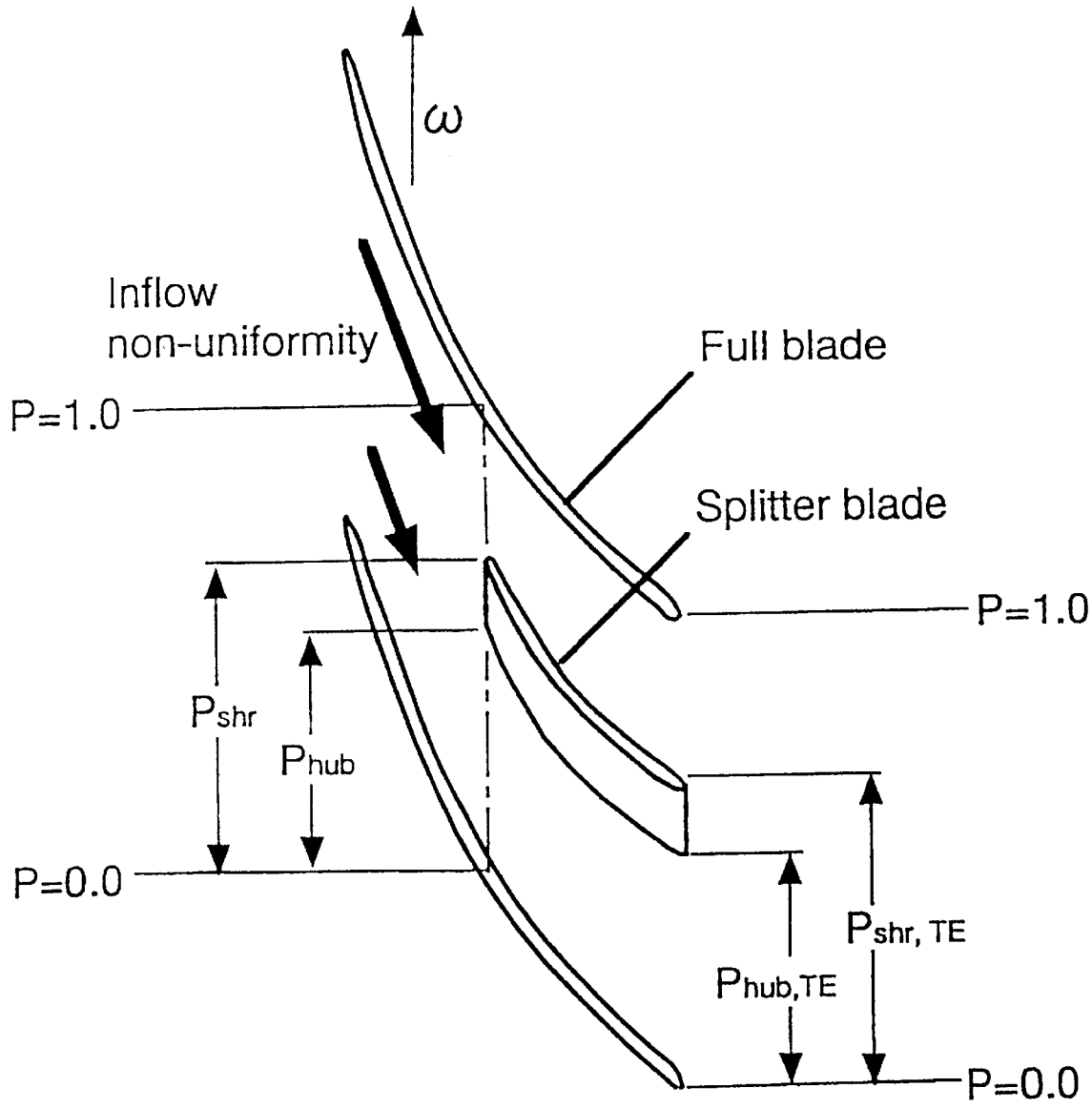
FIG. 7 is a drawing of another embodiment of a compressor impeller with splitter blades of the present invention.
Figure 8:
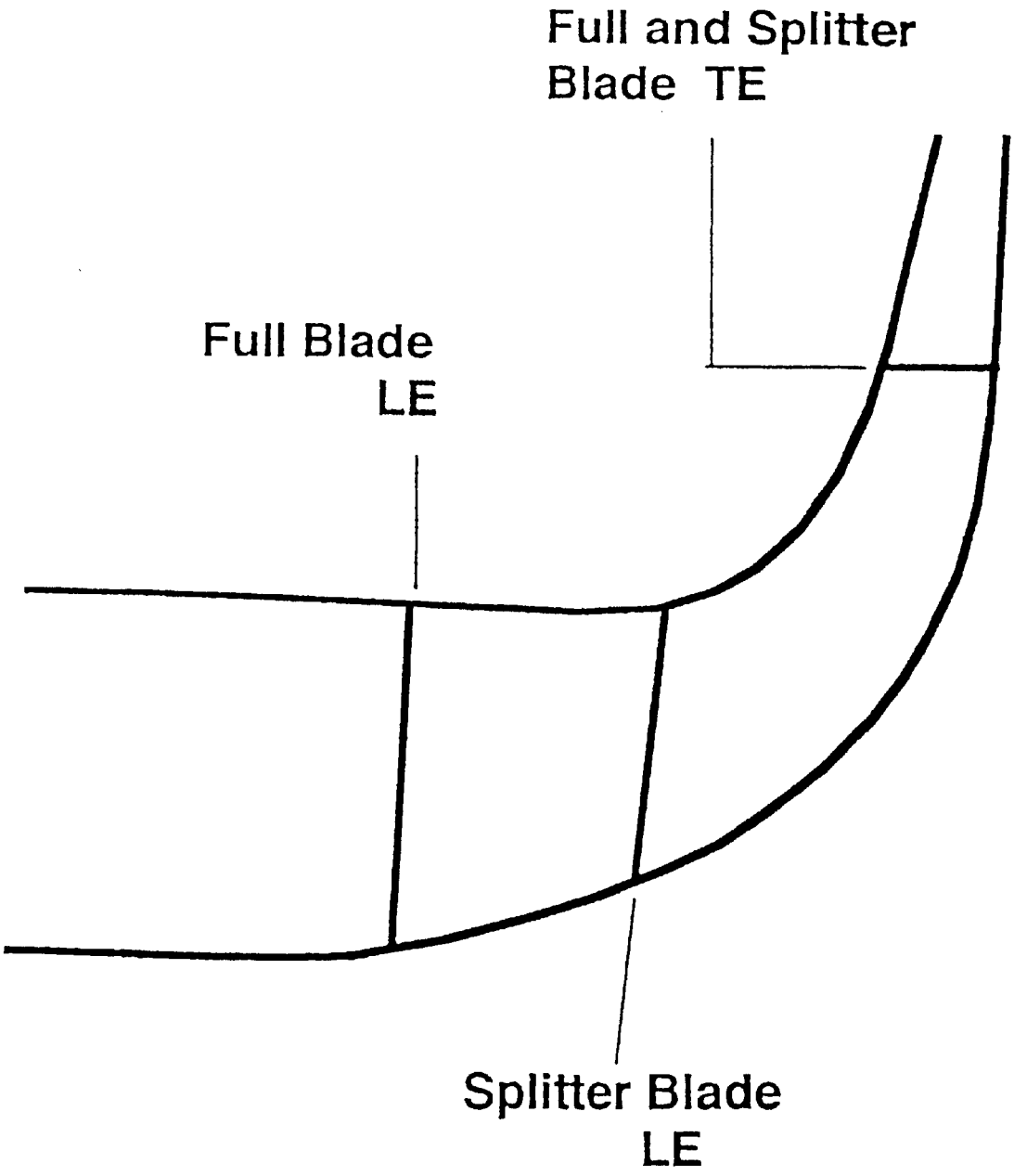
FIG. 8 is a meridional configuration of the impeller with splitter blades according to another embodiment of the present invention.
Figure 9:
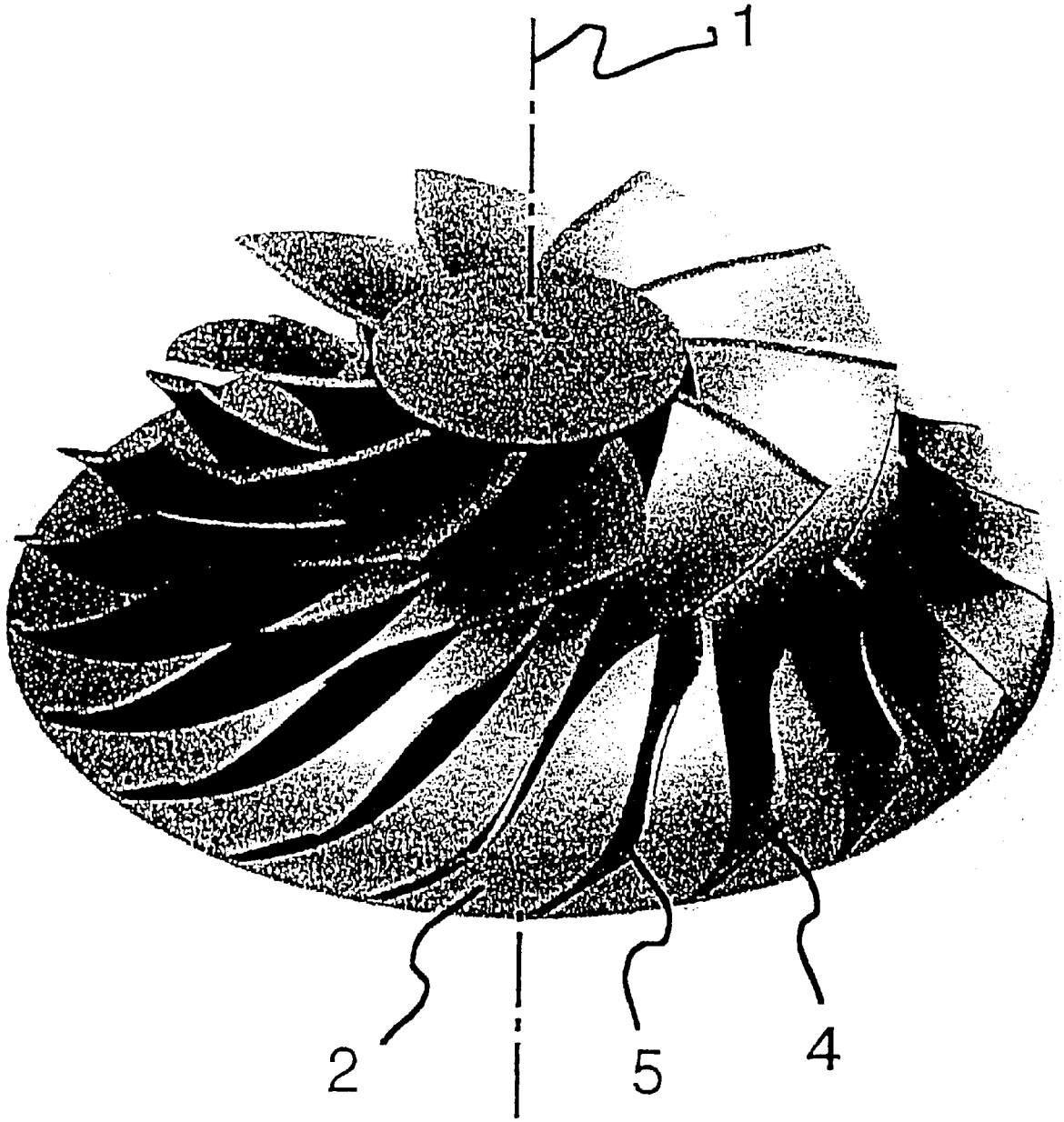
FIG. 9 is a perspective view of the impeller with splitter blades having a specific speed Ns=300.

FIGS. 8~12 refer to embodiments of an impeller used in a centrifugal compressor having a specific speed of about Ns=300. As shown in a meridional configuration in FIG. 8, the position of the splitter blade leading edge in the meridional cross section is at a 31% position of the full blade length on the hub surface, and 40% position of the full blade length on the shroud surface. A three-dimensional perspective view of the embodiment is shown in FIG. 9. The pitchwise position of the splitter blade leading edge on the hub surface is Phub=0.43 (refer to FIG. 5A), its position on the shroud-side is Pshr=0.55, and its position at the mid-span point is Pm=0.49. The trailing edge is positioned in the center of the full blades for both hub- and shroud-sides, i.e., Phub,TE=Pshr,TE=0.5. The blade is aligned to a mid-span position at about a mid-point of the flow passage in the meridional length. Here, the pitchwise position of the splitter blade is represented in terms of a non-dimensional circumferential length P (refer to FIG. 6), which is a distance between the position and a circumferentially corresponding position of a full blade adjacent to a suction side of the splitter blade which is normalized by a pitch distance between the adjacent full blades. The non-dimensional circumferential length P is taken to increase towards a suction surface of the adjacent full blade.

The circumferential position variation of the leading edge along the spanwise direction between the hub and the shroud is preferably determined according to a non-uniformity distribution of fluid flowing into the splitter blade region. For example, in the case where the non-uniformity distribution of the inflow is linear between the hub and the shroud, the position of the leading edge should be varied linearly between the hub and the shroud. If the non-uniformity of the inflow is concentrated at a shroud-side region, it is preferable to adopt a curve of a second or higher degree which changes gently in the region between the hub and the mid-span, and then changes relatively intensively towards the shroud.

As described above, the leading edge of the splitter blade of the present embodiment is formed in such a way that its shroud-side leading edge is positioned closer to the suction surface of an adjacent full blade and its hub-side leading edge is positioned closer to the pressure surface of the other adjacent full blade with respect to the mid-pitch point between the full blades. This is a design to correct the non-uniformity in the flow fields along the spanwise direction in the upstream portion of the splitter blade in the impeller.

Figures 10A, 10B:
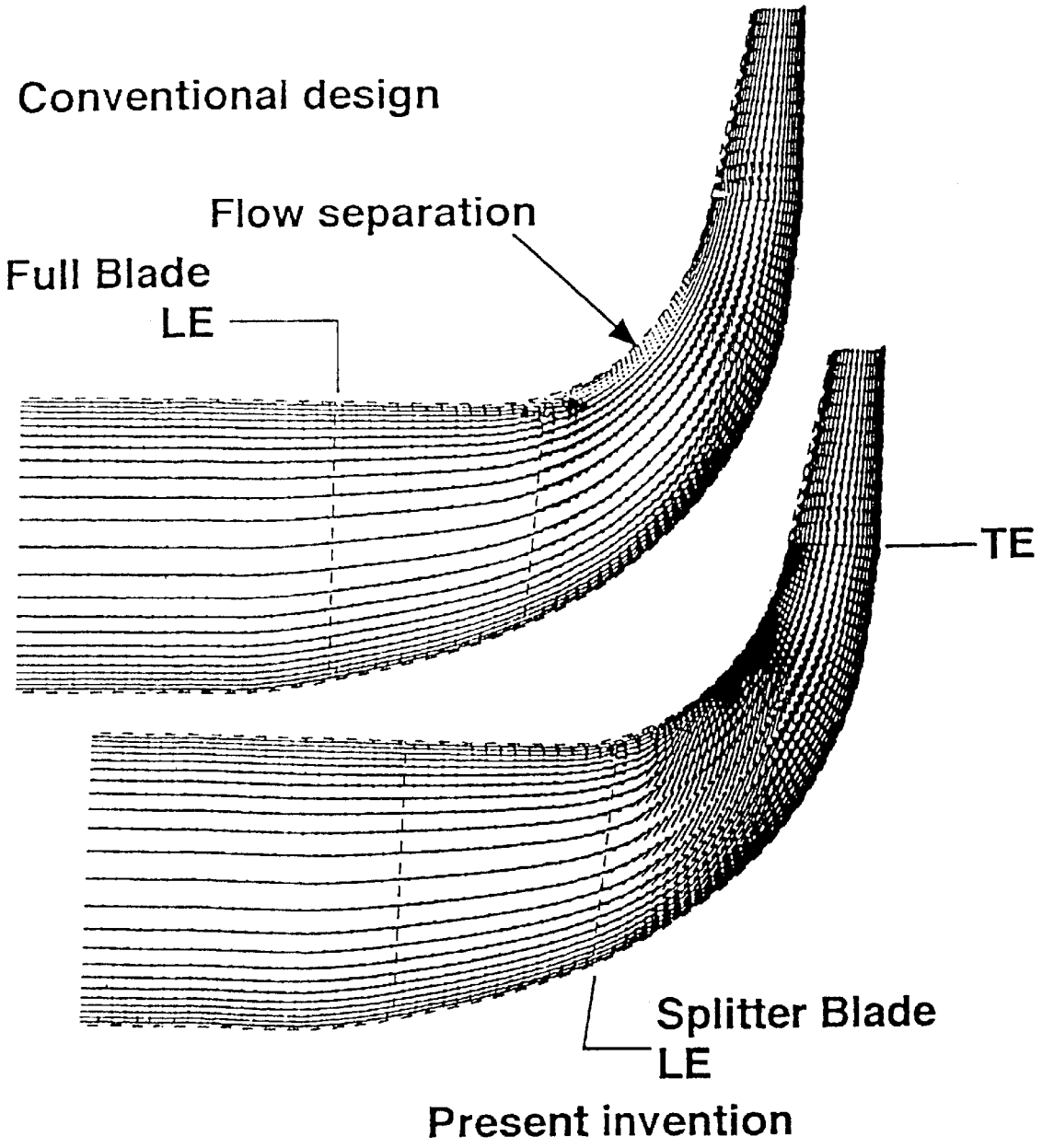
FIGS. 10A and 10B are, respectively, comparative results of the flow field analysis at a design flow rate for the present invention shown in FIG. 9 and that of a conventional impeller.

FIGS. 10A and 10B comparatively show velocity vector distributions in the vicinity of the suction-side of the splitter blade at the design flow rate, computed according to a three-dimensional viscous flow calculation of the present design and the conventional design having the splitter blade at the mid-pitch location. The conventional impeller shown in FIG. 10A produces mismatching in the flow fields in the vicinity of the shroud surface at the splitter blade leading edge, resulting in a wide flow separation region along the shroud surface. In contrast, the present impeller is able to suppress generation of flow separation regions completely, thus producing an excellent flow condition.

Figures 11A, 11B:
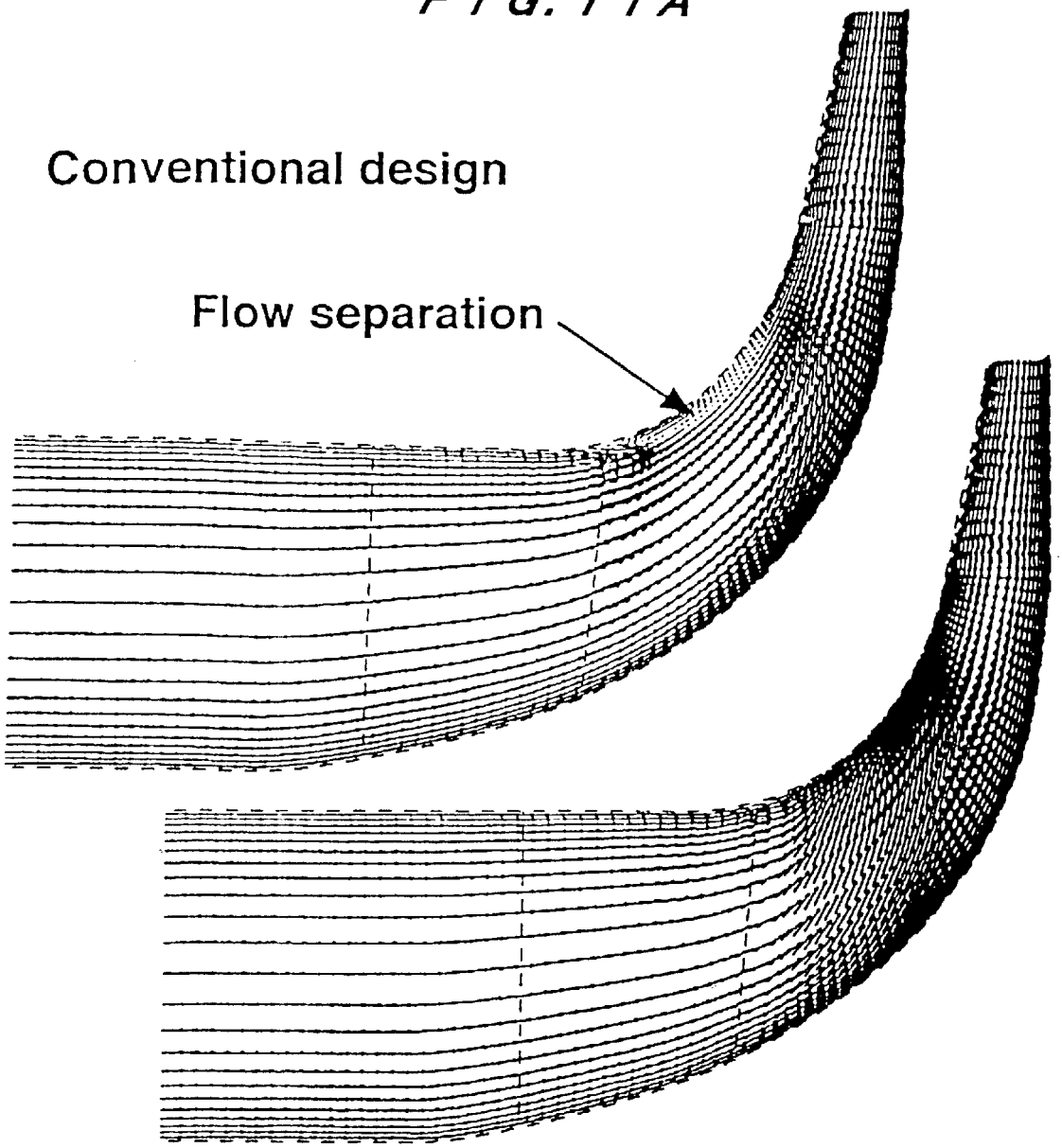
FIGS. 11A and 11B are, respectively, comparative results of the flow field analysis at a flow rate of 110% of the design flow rate for the present invention shown in FIG. 9 and that of a conventional impeller.
Figures 12A, 12B:
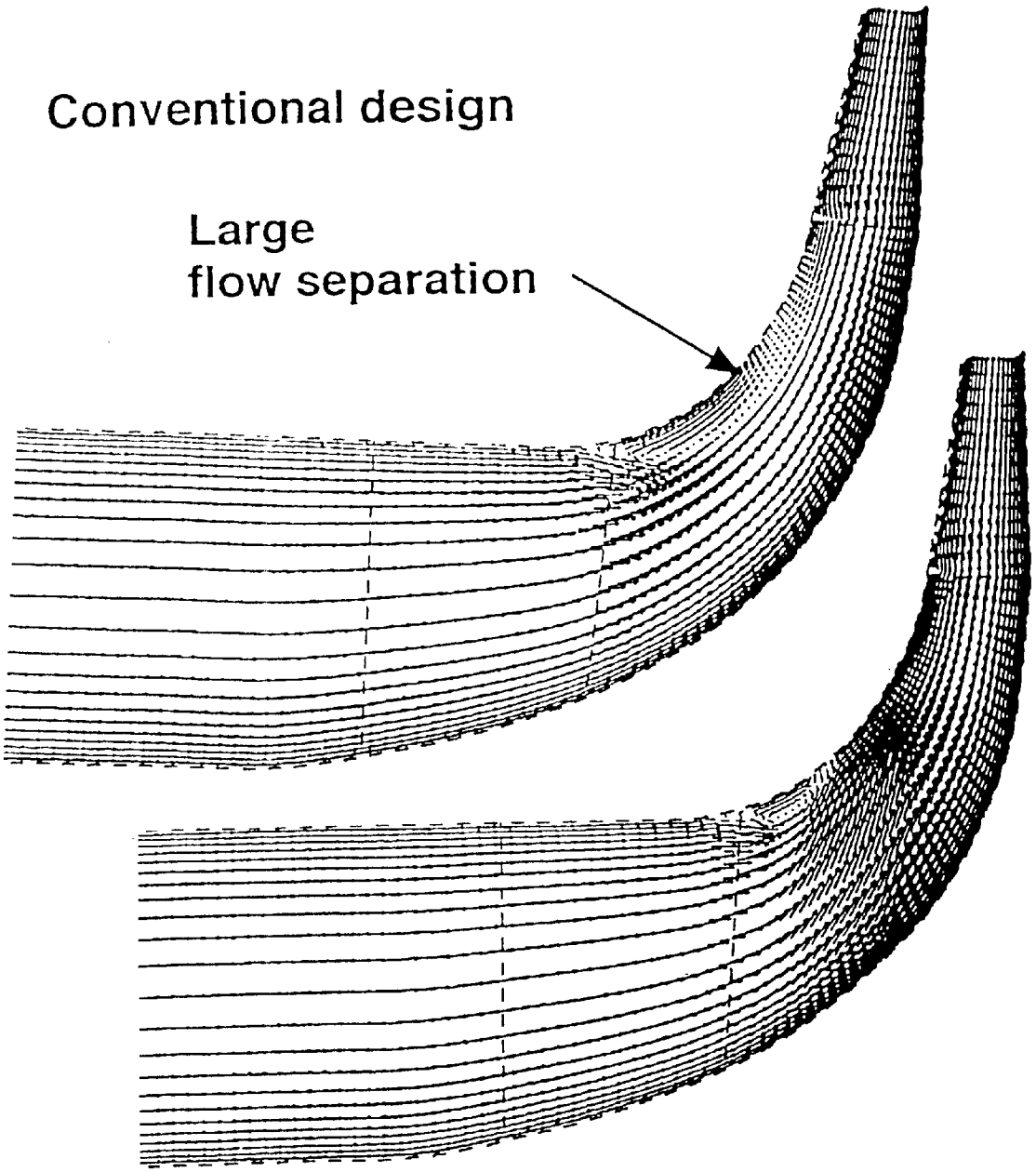
FIGS. 12A and 12B are, respectively, comparative results of the flow field analysis at a flow rate of 85% of the design flow rate for the present invention shown in FIG. 9 and that of a conventional impeller.

FIGS. 11A and 11B show similar comparison results of the flow fields when the flow rate is 110% of the design flow rate, and show that the conventional impeller still produces flow separation while the impeller of the present invention produces no flow separation. FIGS. 12A and 12B show additional comparison results when the flow rate is 85% of the design flow rate. It can be seen that there is a large flow separation caused by an increase in the fluid incidence angle with the decreased flow rate in the conventional impeller, while in the present impeller, flow separation occurs in a very limited small region close to the splitter blade leading edge. Thus, it has been demonstrated in this embodiment that not only the performance at the design flow rate is improved but the operating range of the turbomachinery has been expanded over a wide range of low to high flow rates.

Figure 1A:
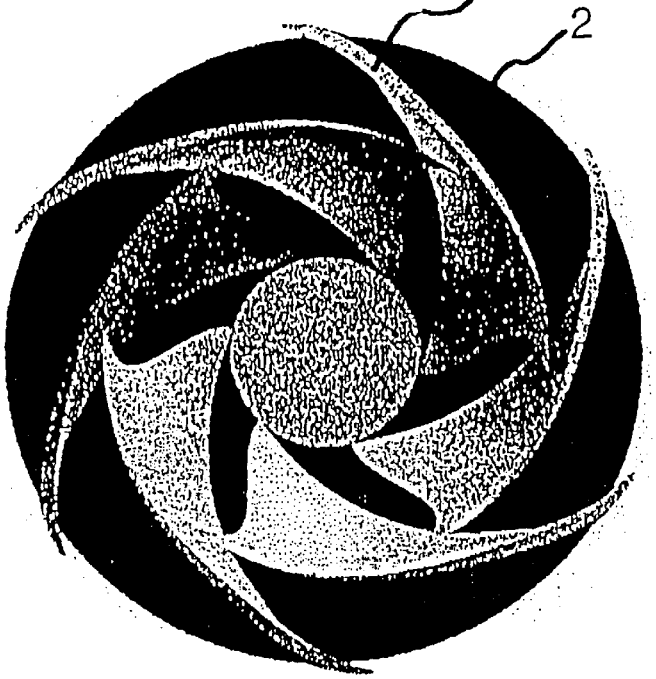
FIG. 1A (PRIOR ART)
FIGS. 1A~1C are perspective views of a conventional impeller with full blades.
Figure 1B:
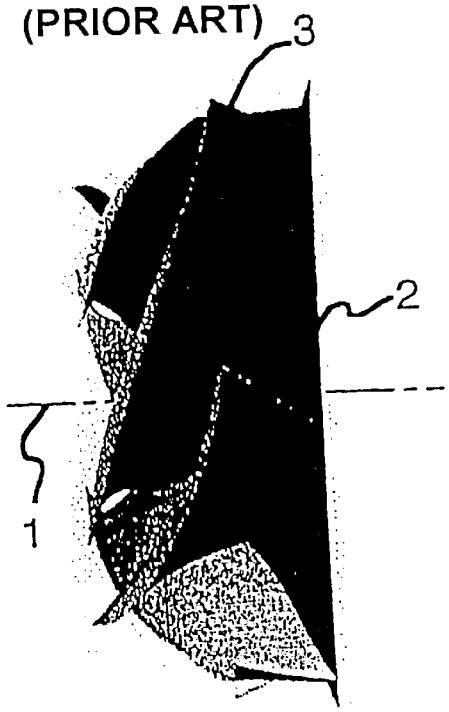
FIG. 1B (PRIOR ART)
Figure 1C:
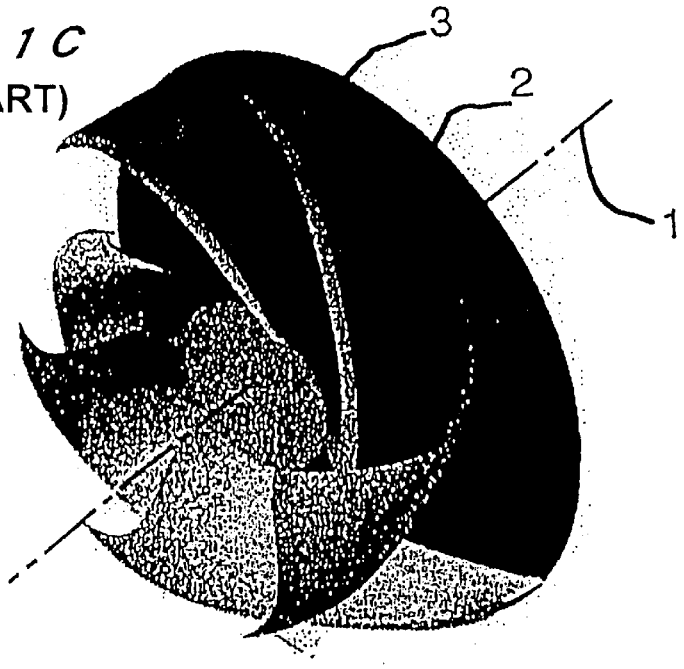
FIG. 1C (PRIOR ART)
Figure 2A:
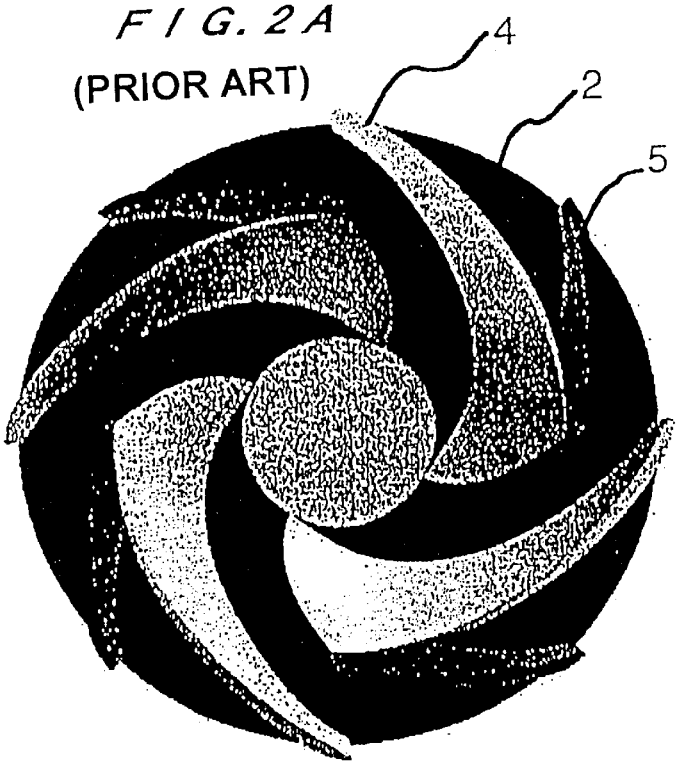
FIG. 2A (PRIOR ART)
FIGS. 2A~2C are perspective views of a conventional impeller with splitter blades.
Figure 2B:
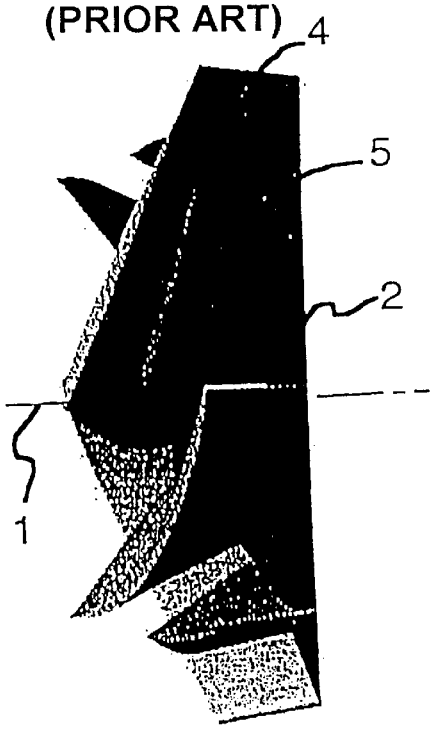
FIG. 2B (PRIOR ART)
Figure 2C:
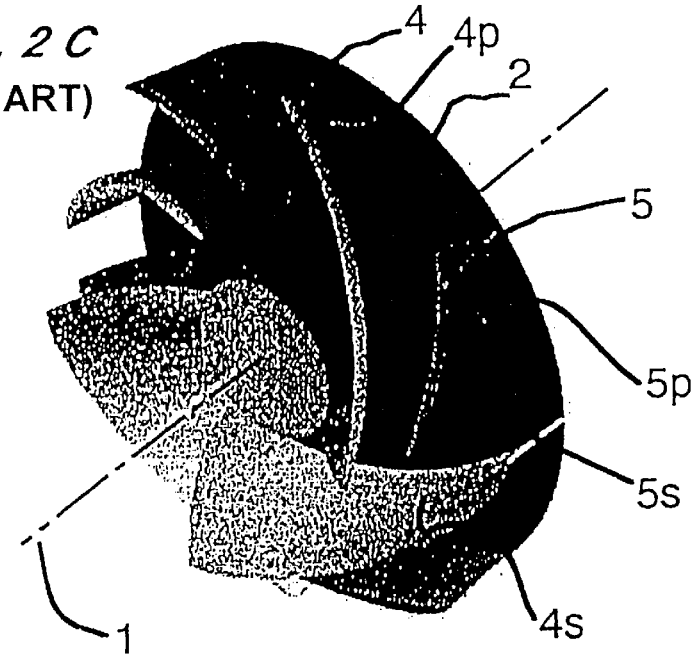
FIG. 2C (PRIOR ART)
Figure 3A:
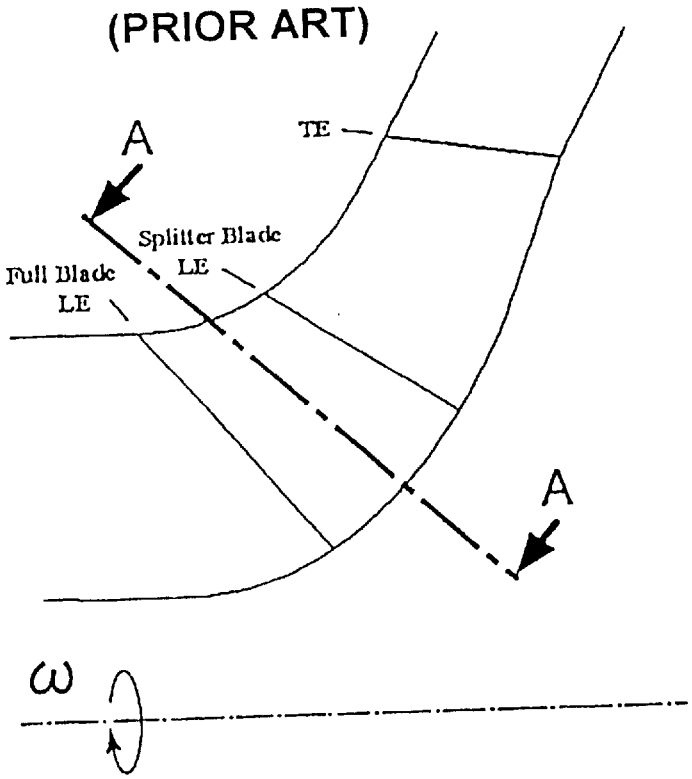
FIG. 3A (PRIOR ART)
FIG. 3A is a meridional configuration of a conventional impeller with splitter blades having a specific speed Ns=400.
Figure 3B:
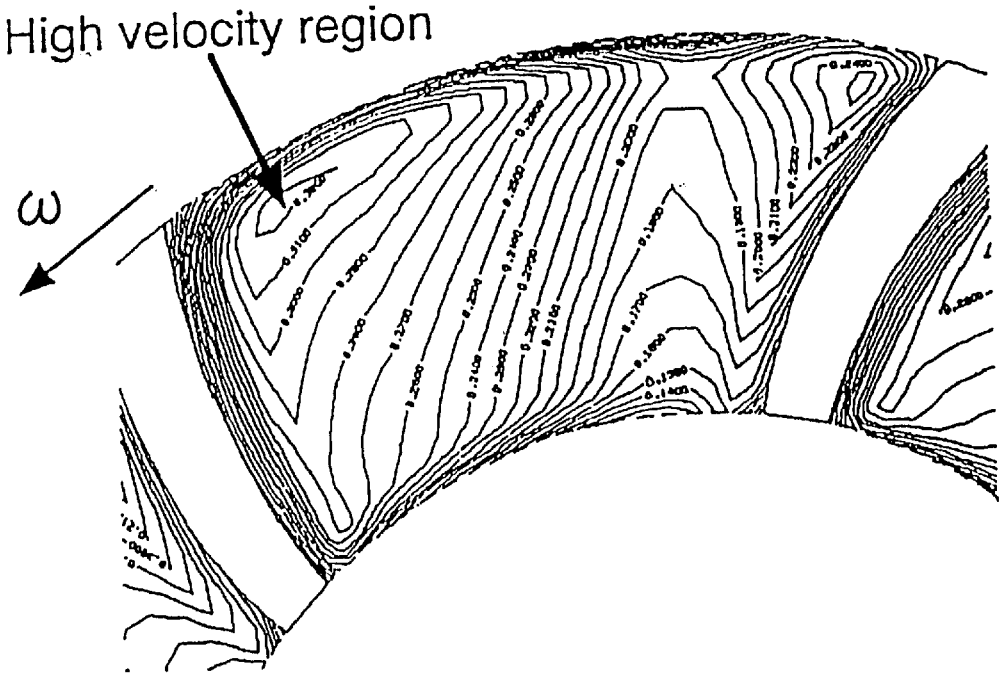
FIG. 3B (PRIOR ART)
FIG. 3B is a meridional velocity distribution pattern of the impeller on an A—A cross section of FIG. 3A.
Figure 4A:
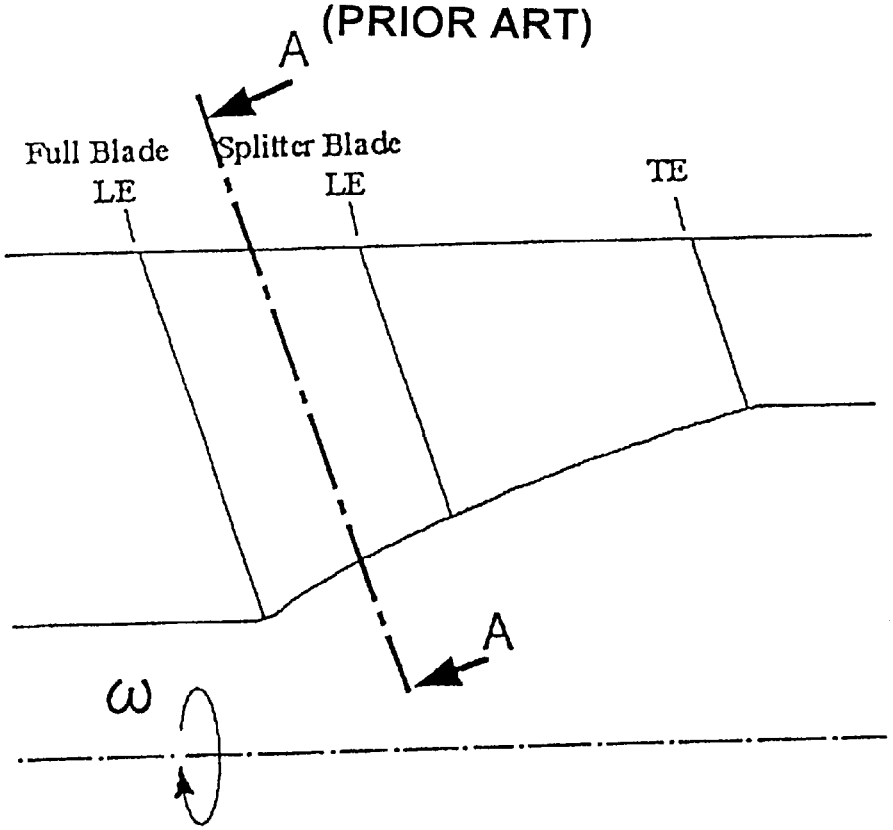
FIG. 4A (PRIOR ART)
FIG. 4A is a meridional configuration of a conventional impeller with splitter blades having a specific speed Ns=800.
Figure 4B:
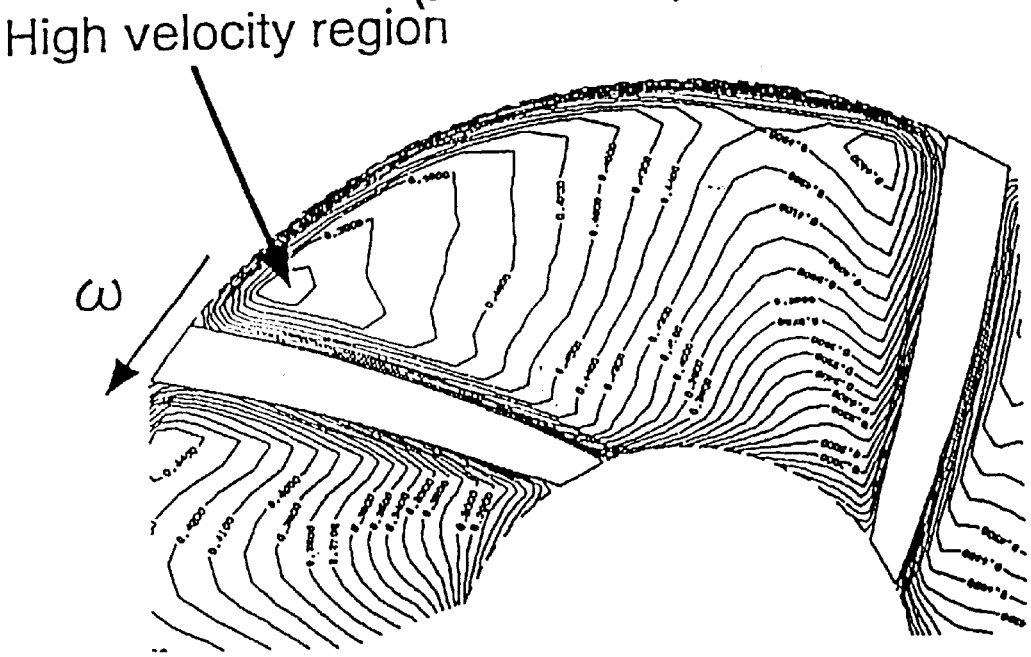
FIG. 4B (PRIOR ART)
FIG. 4B is a meridional velocity distribution pattern of the impeller on an A—A cross section of FIG. 4A.
Figure 13A:
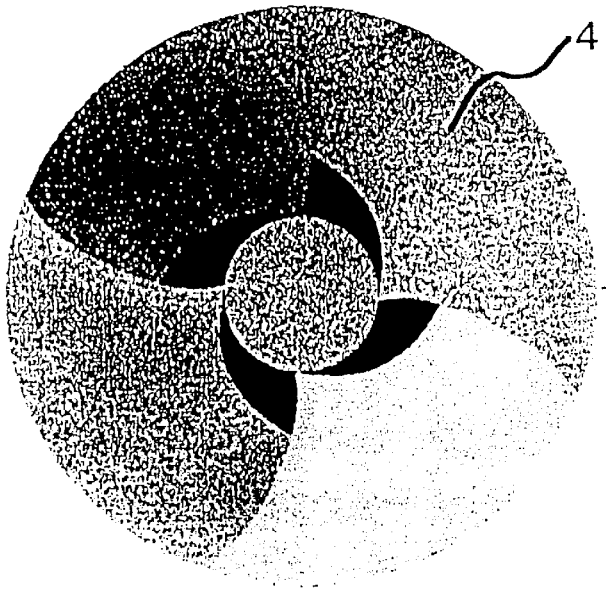
FIGS. 13A~13C are perspective views of a pump impeller with splitter blades having a specific speed Ns=800.
Figure 13B:
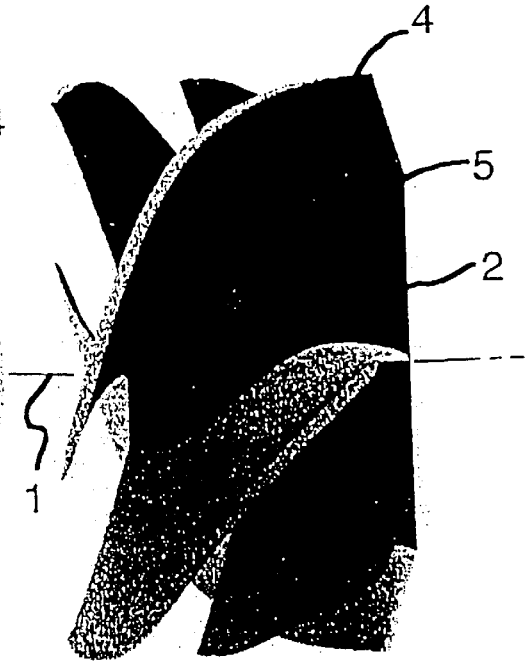
Figure 13C:
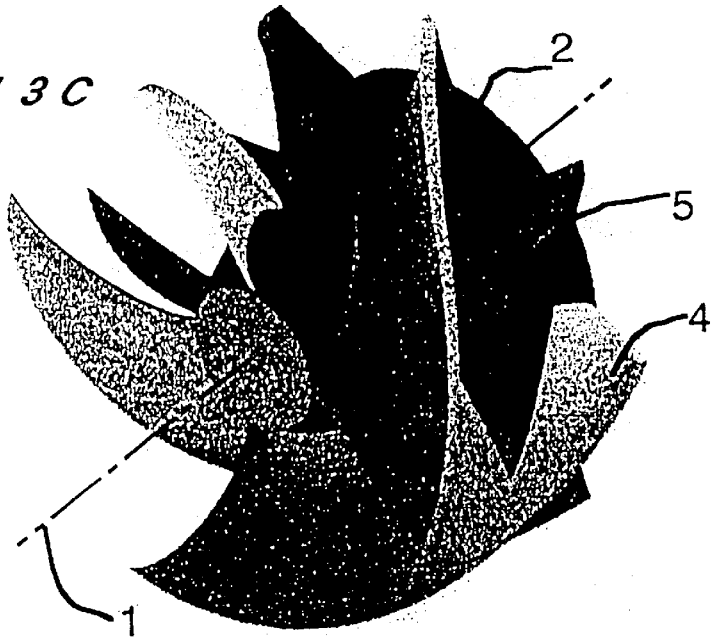

Next, the characteristics of the impeller used in a pump having the meridional profile shown in FIG. 4A and a specific speed Ns=800 will be described. The position of the splitter blade leading edge in the meridional cross section is at 40% meridional length for both hub and shroud ends. FIGS. 13A~13C show a three-dimensional shape of the impeller. Performance characteristics were predicted for the impellers having three different circumferential displacement distributions of the splitter blade leading edge.

Figure 14:
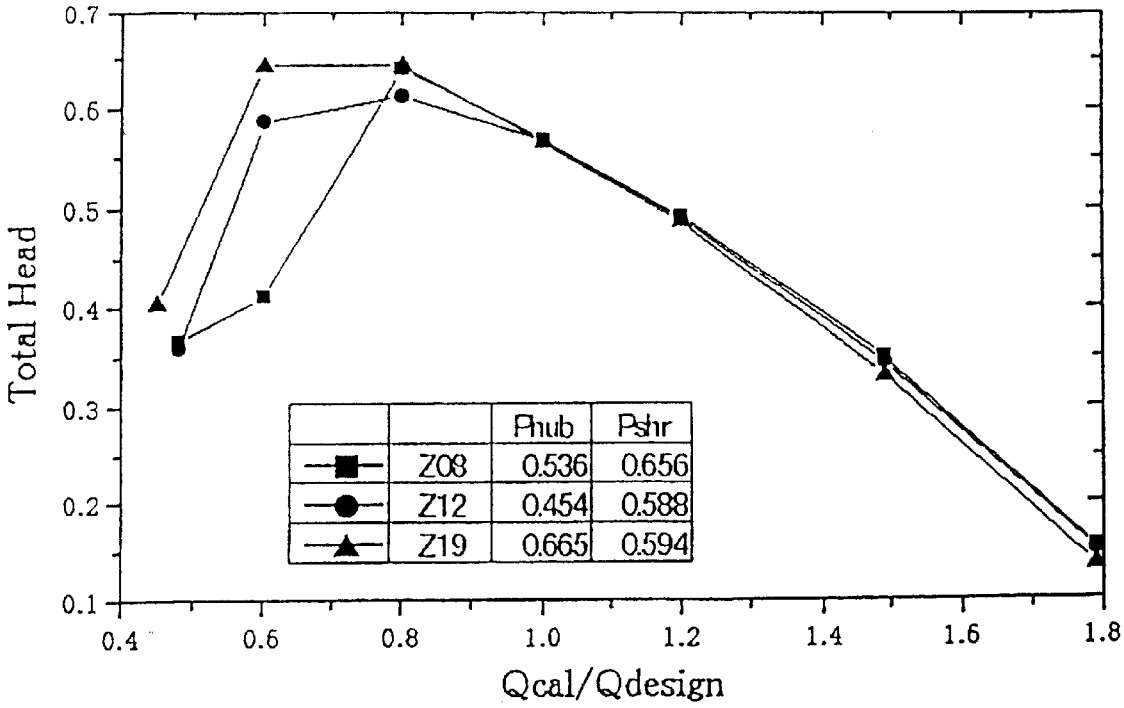
FIG. 14 is a graph showing pressure rise characteristic curves of the pump impeller shown in FIGS. 13A~13C for three different positions of the splitter blade leading edges.

With reference to FIG. 14, Phub=0.536 and Pshr=0.656 in the case of Z08; Phub=0.454 and Pshr=0.588 in the case of Z12; and Phub=0.665 and Pshr=0.594 in the case of Z19. Thus, the position of the splitter blade leading edge at the shroud-side in the case of Z08 is further displaced towards the suction side of the full blade compared with case Z12. In the case of Z19, the hub-side leading edge is further displaced towards the suction surface of the adjacent full blade compared with the shroud side.

Figure 15:
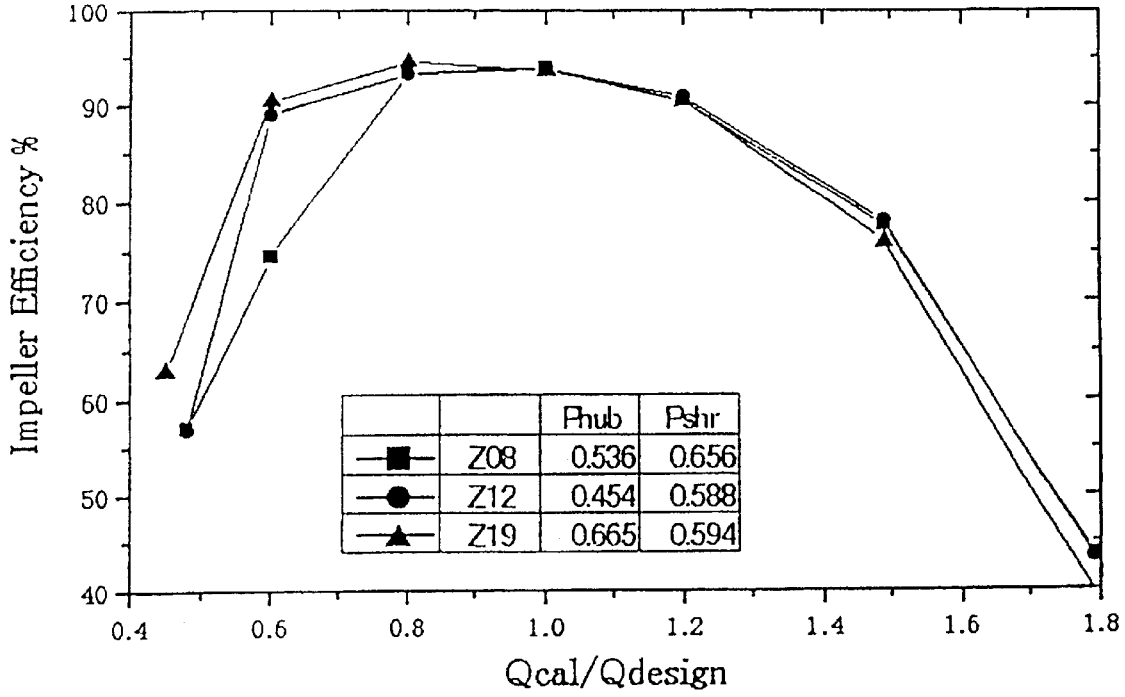
FIG. 15 is a graph showing impeller efficiency curves of the pump impeller shown in FIGS. 13A~13C for three different positions of the splitter blade leading edges.

FIG. 14 shows the changes in pressure rise coefficient of the impeller with respect to the fluid flow rates of the pump, and FIG. 15 shows changes in the impeller efficiency. The impellers of the present invention achieved almost the same high efficiencies in the region of design flow rate but in flow rate regions away from the design flow rate, the efficiencies dropped as in the case of conventionally designed impellers. FIGS. 17A~19C show predicted flow fields at a flow rate of 60% of the design flow rate which is in a partial capacity range.

Figure 16A:
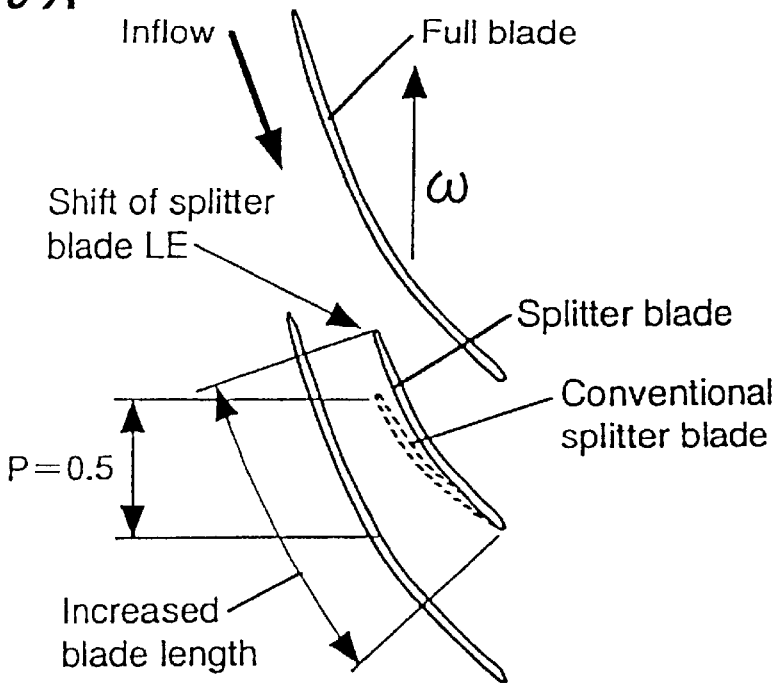
FIGS. 16A~16C are schematic drawings to explain the effects of altering the position of the splitter blade leading edge.

As shown in FIG. 14, the increase in the pressure rise coefficient began to slow down at flow rates less than 80% in the case of Z12, and at flow rates less than 60%, the head/flow rates characteristics showed a positively sloped curve indicating a possible occurrence of flow field instability. In the case of Z08, by increasing the degree of displacement of the splitter blade leading edge, the pressure rise coefficient remained higher than the values in Z12 down to a flow rate of 80%. As schematically illustrated in FIG. 16A, this is because, as a result of the displacement of the splitter blade towards the suction surface side of the full blade, the effective length of the splitter blade is increased so that the load per unit area of the splitter blade is decreased. As can be understood by comparing the flow fields presented in FIGS. 17C and 18C, flow separation on the suction surface of the splitter blade is less in Z08 compared with that in Z12.

However, when the splitter blade leading edge is displaced so close to the suction surface of the full blade as in the case of Z08, the flow passage along the latter half of the full blade suction surface is intensively enlarged, and a large scale flow separation is generated on the suction surface of the full blade in the partial capacity range. The result is that, in the case of Z08, rapid drop in the pressure rise coefficient and impeller efficiency are produced by the occurrence of a stall of the impeller. FIGS. 17A~17C show flow fields inside the impeller at such a flow condition, and it can be confirmed that large scale flow separations and reverse flows are produced on the suction surface of the full blade.

Figure 16B:
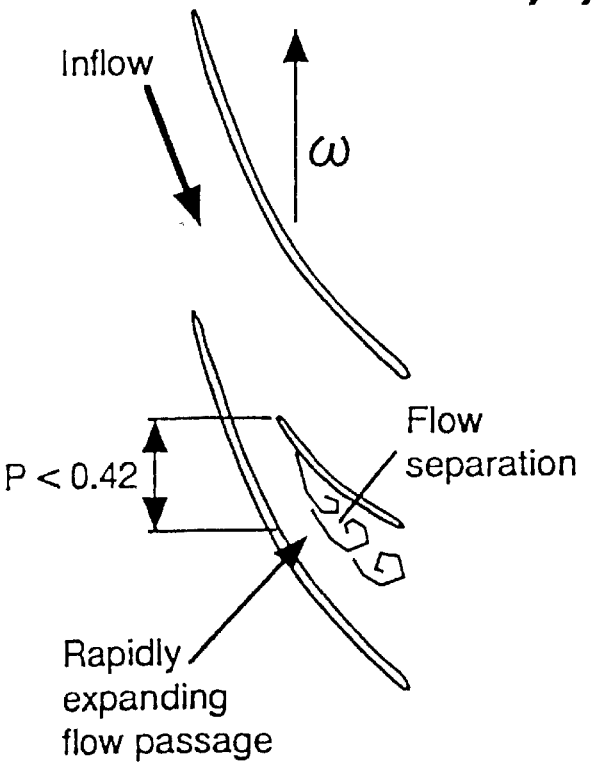
Figure 16C:
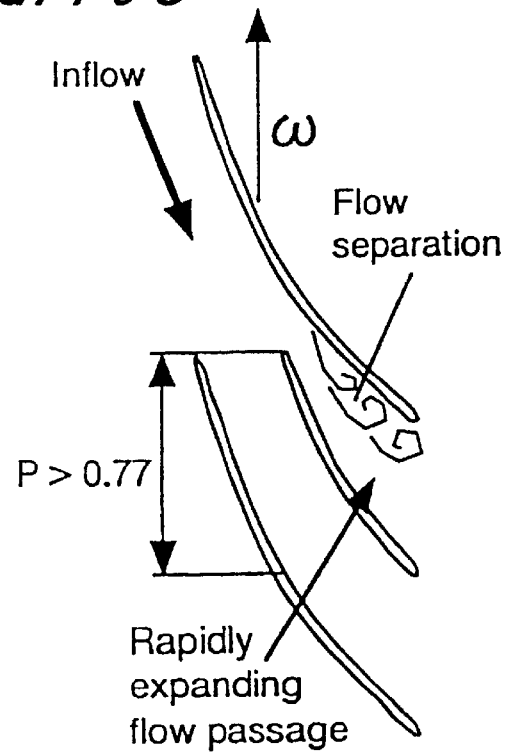

When the degree of displacement of the splitter blade leading edge towards the suction surface of the adjacent full blade is in excess, as shown in FIG. 16C, a large scale flow separation will be generated in the latter half of the suction surface of the full blade even at a designed flow rate, which causes an obstruction against a high efficiency. From such a standpoint, we have reviewed the maximum circumferential displacement of the splitter blade leading edge towards the suction surface of an adjacent full blade, and found that the critical limit stays at P=0.77 on both hub- and shroud-side edges.

Depending on the state of the inflow, it may be appropriate to displace the splitter blade leading edge towards the pressure surface of the adjacent full blade. However, when the degree of displacement is in excess, the flow passage along the splitter blade suction surface is intensively enlarged as shown in FIG. 16B, and a large scale flow separation will be generated on the suction surface of the splitter blade even at a designed flow rate, which also causes an obstruction against a high efficiency. From such a standpoint, we have examined the minimum circumferential displacement of the splitter blade leading edge, and found that the critical limit stays at P=0.42 on both hub- and shroud-side edges.

As indicated above, although stall phenomenon is not generated in the full blade in the case of Z12, flow separations are observed on the shroud-side of the suction surface of the splitter blade in FIG. 18C, and causes a loss in pressurization at flow rates less than 80%. In the present invention, such performance characteristics can be further improved in a variety of operating conditions, including the partial capacity range, by optimizing the three-dimensional shape of the splitter blade.

In the case of Z19, the degree of displacement of the shroud-side splitter blade is kept the same as in the case of Z12, but the hub-side splitter blade leading edge is further displaced towards the suction-surface of the full blade compared with Z12. By adopting such a three-dimensional configuration of the splitter blade, the effective length of the hub-side splitter blade was increased to produce a reduction in the load per unit area of the splitter blade to avoid the flow separation. Although, along the latter half of the hub-side full blade suction surface, an intensive expansion of the flow passage occurs similar to the case shown in FIG. 16C, as long as the displacement is not beyond the critical limit described with respect to FIG. 16C, there hardly exists any possibility of generating flow separation. FIGS. 19A–19C show the flow fields in the impeller under this condition, and it can be observed that the flow separation is significantly lessened on the shroud-side of the splitter blade, and as indicated in FIG. 14, high performance is achieved down to flow rates as low as 60%.

When a large-scale flow separation is generated on the splitter or full blades, the outflow becomes extremely non-uniform, and the loss due to outflow mixing will cause a drop in impeller efficiency, but also a significant drop in the overall performance of the turbomachinery is caused by deteriorated conditions in the flow fields of the fluid flowing into the downstream diffuser section. Even when flow mismatching and non-uniform flow fields are small at the design flow rate, as shown in FIG. 14, there is a possibility of increasing adverse effects in the regions of off-design flow rates. Therefore, it is important to configure the shape of the splitter blade in detail according to the required specific characteristics by using the present invention so as to optimize the flow fields within the impeller.

In all of the above embodiments presented, the pitchwise position of the trailing edge of the splitter blades at the exit section of the impeller is chosen to be in the middle of the adjacent full blades, and displacements of the blades are not introduced along the spanwise direction. However, as already described by referring to FIG. 16C, it is not desirable to have an extreme degree of displacement of the splitter blade leading edge, because an intensive expansion in the flow passage along the latter half of the full blade suction surface is formed as shown with reference to the case of Z08. In the following embodiments, this problem is solved by moving the trailing edge of the splitter blade to correspond with the leading edge of the same splitter blade in the pitchwise direction.

Figure 20:
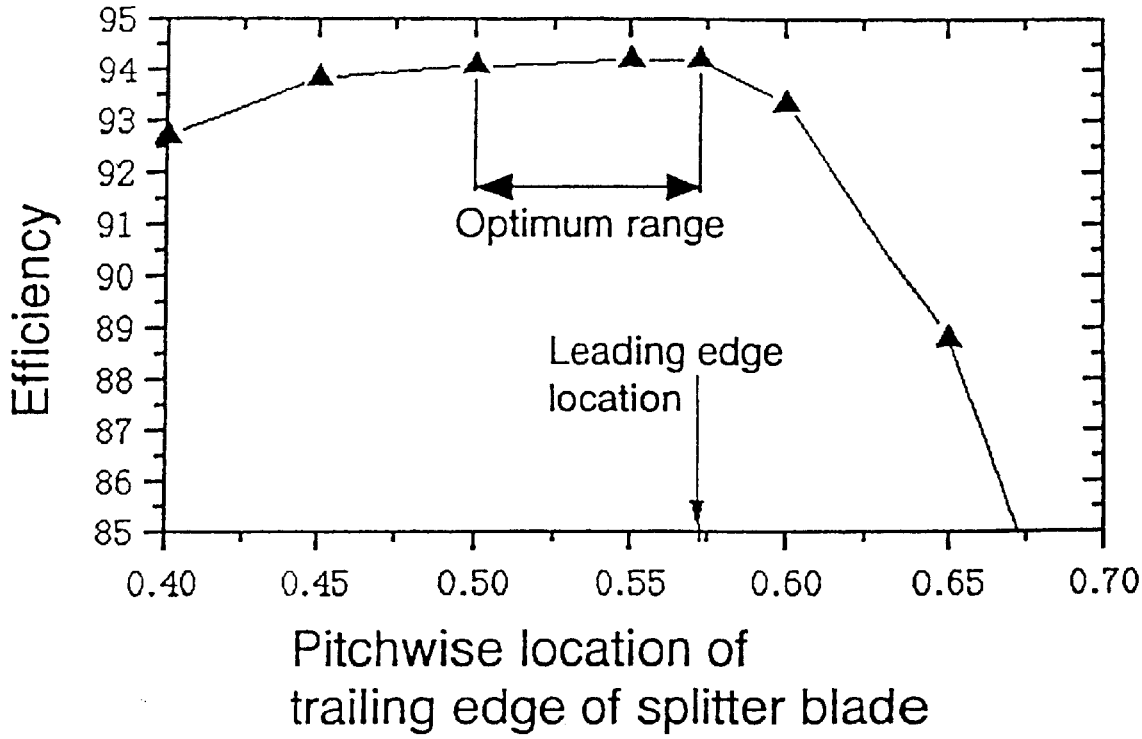
FIG. 20 is a graph showing the changes in impeller efficiency relative to change of position of the splitter blade trailing edge.

FIG. 20 shows a relationship between the pitchwise position of the splitter blade trailing edge and impeller efficiency for a pump having a specific speed Ns=800 obtained by a three-dimensional viscous flow calculation. The leading edge of the splitter blade is at Pm=0.57 at the center of the blade span.

As can be understood from the results in FIG. 20, as the splitter blade trailing edge position becomes lower than Pm=0.5 and the degree of expansion of the flow passage along the latter half of the full blade suction surface becomes large, the impeller efficiency is rapidly decreased due to the flow separation at the full blade suction surface. Also, as the splitter blade trailing edge position becomes closer to the full blade suction surface than the corresponding leading edge position, the degree of expansion of the flow passage along the splitter blade suction surface increases, and flow separation is observed on the splitter blade suction surface. Therefore, it may be understood that the impeller efficiency is increased by displacing the splitter blade trailing edge from the mid-pitch point between the adjacent full blades within a range not exceeding the corresponding pitchwise location of the splitter blade leading edge at the same spanwise position.

What is claimed is:

1. An impeller for a turbomachine, comprising:

a hub;

full blades equidistantly disposed on said hub in a circumferential direction; and a splitter blade disposed between each adjacent two of said full blades, wherein said splitter blade is shaped such that a non-dimensional circumferential position of a leading edge of said splitter blade varies in a spanwise direction.

2. The impeller according to claim 1, wherein a flow passage formed between each one of said full blades and a corresponding said splitter blade is shaped in such a way that a flow separation on an aft part of suction surfaces of said each one of said full blades and said corresponding said splitter blade is avoided.

3. The impeller according to claim 1, wherein said splitter blade is shaped in such a way that a position of said leading edge of said splitter blade at a blade tip is displaced away from a mid-pitch position of adjacent ones of said full blades.

4. The impeller according to claim 1, wherein said non-dimensional circumferential position of said leading edge of said splitter blade varies in a spanwise direction by varying linearly relative to a distance from a surface of said hub.

5. The impeller according to claim 1, wherein said non-dimensional circumferential position of said leading edge of said splitter blade varies in a spanwise direction by varying along a second or higher degree curve relative to a distance from a surface of said hub.

6. The impeller according to claim 1, wherein a position of said leading edge of said splitter blade is located within a range of non-dimensional parameter P as expressed by the following inequality relation:

$$0.42<P<0.77,$$

where P is a pitchwise distance between said position and a circumferentially corresponding position on a blade camber line of one of said full blades adjacent to a suction side of said splitter blade which is normalized by a pitch distance between adjacent ones of said full blades.

7. The impeller according to claim 1, wherein a blade tip side position of said leading edge of said splitter blade is located nearer to a suction surface of an adjacent one of said full blades than to a pressure surface of another adjacent one of said full blades.

8. The impeller according to claim 1, wherein a hub side position of said leading edge of said splitter blade is located nearer to an opposing suction surface of an adjacent one of said full blades than to a blade tip side position of said leading edge of said splitter blade.

9. The impeller according to claim 1, wherein a trailing edge of said splitter blade is displaced from a mid-pitch position of corresponding adjacent ones of said full blades in a circumferential direction.

10. The impeller according to claim 9, wherein said trailing edge of said splitter blade is located between a mid-pitch position of said corresponding adjacent ones of said full blades and a corresponding non-dimensional pitch-wise location of said leading edge of said splitter blade at the same spanwise position.

* * * * *